US008425267B2

(12) United States Patent
Harpin et al.

(10) Patent No.: US 8,425,267 B2
(45) Date of Patent: Apr. 23, 2013

(54) SELF-PROPELLED SHIP

(75) Inventors: Dominique Harpin, Saint Nazaire (FR); Maarten Mostert, Hyeres (FR)

(73) Assignee: STX France S.A., Saint Nazaire (FR)

( * ) Notice: Subject to any disclaimer, the term of this patent is extended or adjusted under 35 U.S.C. 154(b) by 89 days.

(21) Appl. No.: 12/921,531

(22) PCT Filed: Nov. 9, 2009

(86) PCT No.: PCT/EP2009/064832

§ 371 (c)(1), (2), (4) Date: Dec. 6, 2010

(87) PCT Pub. No.: WO2010/055010

PCT Pub. Date: May 20, 2010

(65) Prior Publication Data

US 2012/0001479 A1 Jan. 5, 2012

(30) Foreign Application Priority Data

Nov. 13, 2008 (FR) ..... 08 57681

(51) Int. Cl.
*B63H 21/17* (2006.01)

(52) U.S. Cl.
USPC ..... 440/6

(58) Field of Classification Search ..... 440/3, 6, 440/8, 9; 307/9.1, 48
See application file for complete search history.

(56) References Cited

U.S. PATENT DOCUMENTS 5,199,912 A * 4/1993 Dade et al. ..... 440/6
5,863,228 A * 1/1999 Tether ..... 440/6
7,241,192 B2 7/2007 Andersen et al.
7,253,538 B2 8/2007 Fujita
7,980,905 B2 * 7/2011 Rembach et al. ..... 440/6

FOREIGN PATENT DOCUMENTS

| | | |
|---|---|---|
| DE | 968 958 | 4/1958 |
| DE | 10 2005 004 9 | 8/2006 |
| DE | 102005056699 | 6/2007 |
| EP | 1 341 694 | 9/2003 |
| EP | 1 531 125 | 5/2005 |
| EP | 1651512 | 5/2006 |
| EP | 1 826 117 | 8/2007 |
| EP | 2 106 999 | 10/2009 |
| FR | 2660093 | 9/1991 |
| JP | 2000-139041 | 5/2000 |
| JP | 2009-262925 | 11/2009 |
| WO | WO 02/47974 | 6/2002 |
| WO | WO 02/100716 | 12/2002 |
| WO | WO 2005/012079 | 2/2005 |

(Continued)

*Primary Examiner* — Lars A Olson
(74) *Attorney, Agent, or Firm* — Harness, Dickey & Pierce, P.L.C.

(57) ABSTRACT

The disclosure concerns a self-propelled ship comprising a shipboard electric network, a main electrical supply bus, propulsion means, a motor for driving the propulsion means, and means for supplying electricity to them. According to the disclosure, the supply means comprise a set of electric capacitors having a capacitance sized to provide, at their nominal electrical charge, at least temporarily, both of the nominal supply of the shipboard network and of the electric motor through the bus, and electrical connection means arranged on board the ship for connecting the set of electric capacitors to another electric network located at an arrival and/or departure point of the ship, for the purpose of recharging the capacitors to their nominal charge and to supply the first network during a stop at the arrival and/or departure point.

12 Claims, 7 Drawing Sheets

FOREIGN PATENT DOCUMENTS

| | | |
|---|---|---|
| WO | WO 2006/108418 | 10/2006 |
| WO | WO 2007/060189 | 5/2007 |
| WO | WO 2007/060244 | 5/2007 |

* cited by examiner

SELF-PROPELLED SHIP

CROSS-REFERENCE TO RELATED APPLICATIONS

This application is a National Phase Entry of International Application No. PCT/EP2009/064832, filed on Nov. 9, 2009, which claims priority to French Application 0857681, filed on Nov. 13, 2008, both of which are incorporated by reference herein.

BACKGROUND AND SUMMARY

The invention relates to a self-propelled ship. The invention relates in particular to a self-propelled ship assigned to navigation over a prescribed distance situated between a departure point and an arrival point. Such ships are for example marine or river ferries. The ship is for example of the ferry type or any other ship for transporting travelers or cargo.

One of the problems of self-propelled ships is their $CO_2$ footprint and the cost of fossil fuels. In fact, ships usually operate with diesel engines. Numerous alternative systems to diesel engines are known for ships. Document WO 2005/012 079 describes a ship with photovoltaic cells arranged on a sail, as well as batteries and/or capacitors for storing the electricity collected by the cells. This ship is of the recreational sailboat type, without a diesel engine, and cannot be generalized to the scale of a large size ship such as a ferry in regular service. Document EP-B-1 341 694 concerns a ship equipped with a main Diesel engine and an electrical motor supplied with electricity by a generator set equipped with another Diesel engine. Document EP-A-1 531 125 describes a ship provided, for its propulsion, with an electric motor supplied with electricity by Diesel engines and by a fuel battery.

The invention seeks to obtain a ship that dispenses with internal combustion engines, partially or totally, for its propulsion. To this end, a first object of the invention is a self-propelled ship assigned to navigation over a prescribed distance situated between a departure point and an arrival point, the ship comprising at least a first shipboard electric network, at least one main electrical supply bus, propulsion means, at least one drive motor for driving said propulsion means, and supply means for supplying with electricity the first shipboard electric network and said at least one drive motor through said main electrical supply bus, wherein the supply means comprise at least one set of electric capacitors having a capacitance sized so as to provide, at their nominal electrical charge, a ratio equal to at least 5% of both of the nominal supply of said at least one first shipboard electric network over the prescribed distance and of the nominal electrical supply of said at least one electrical drive motor allowing travel over the prescribed distance through said main electrical supply bus, and, electrical connection means arranged on board the ship to connect the set of electric capacitors to another electric network located at the arrival point and/or departure point for the purpose of recharging the capacitors to their nominal charge and for supplying the first shipboard electric network during a stop at the arrival point and/or the departure point.

The invention also concerns a self-propelled ship assigned to navigation over a prescribed distance situated between a departure point and an arrival point, the ship comprising at least a first shipboard electric network, at least one main electrical supply bus, propulsion means, at least one drive motor for driving said propulsion means, and supply means for supplying with electricity the first shipboard electric network and said at least one drive motor through said main electrical supply bus, wherein the supply means comprise at least one set of electric capacitors having a capacitance sized so as to provide, at their nominal electrical charge, a ratio equal to at least 25% of both of the nominal supply of said at least one first shipboard electric network over the prescribed distance and of the nominal electrical supply of said at least one electrical drive motor allowing travel over the prescribed distance through said main electrical supply bus, and, electrical connection means arranged on board the ship to connect the set of electric capacitors to another electric network located at the arrival point and/or departure point for the purpose of recharging the capacitors to their nominal charge and for supplying the first shipboard electric network during a stop at the arrival point and/or the departure point.

The invention also relates to a self-propelled ship, the ship comprising at least a first shipboard electric network (5), at least one main electrical supply bus (11, 104), propulsion means (3), at least one drive motor (4, 1004) for driving said propulsion means (3), and supply means for supplying with electricity the first shipboard electric network (5) and said at least one drive motor (4, 1004) through said main electrical supply bus (11, 104), wherein the supply means comprise at least one set (10) of electric capacitors having a capacitance sized so as to provide, at their nominal electrical charge, both of the nominal supply of said at least one first shipboard electric network (5) over a prescribed distance and of the nominal electrical supply of said at least one electrical drive motor (4, 1004) allowing travel over the prescribed distance through said main electrical supply bus (11, 104), and, electrical connection means (25, 111) arranged on board the ship to connect the set (10) of electric capacitors to another electric network located at the arrival point and/or departure point of the ship for the purpose of recharging the capacitors to their nominal charge and for supplying the first shipboard electric network during a stop at the arrival point and/or the departure point.

The invention also relates to a self-propelled ship, the ship comprising at least a first shipboard electric network (5), at least one main electrical supply bus (11, 104), propulsion means (3), at least one drive motor (4, 1004) for driving said propulsion means (3), and supply means for supplying with electricity the first shipboard electric network (5) and said at least one drive motor (4, 1004) through said main electrical supply bus (11, 104), wherein the supply means comprise at least one set of electric capacitors (10) having a capacitance sized so as to provide, at their nominal electrical charge, at least temporarily, both of the nominal supply of said at least one first shipboard electric network (5) and of the nominal electrical supply of said at least one electric drive motor (4, 1004) through said main electrical supply bus (11, 104), and electrical connection means (25, 111) arranged on board the ship for connecting the set of electric capacitors (10) to another electric network located at an arrival point and/or at a departure point of the ship, for the purpose of recharging the capacitors to their nominal charge and to supply the first shipboard electric network (5) during a stop at the arrival point and/or at the departure point.

The invention also relates to a self-propelled ship, the ship comprising at least a first shipboard electric network (5), at least one main electrical supply bus (11, 104), propulsion means (3), at least one drive motor (4, 1004) for driving said propulsion means (3), and supply means for supplying with electricity the first shipboard electric network (5) and said at least one drive motor (4, 1004) through said main electrical supply bus (11, 104), wherein the supply means comprise at least one set (10) of electric capacitors having a capacitance sized so as to provide, at their nominal electrical charge, both of the nominal supply of said at least one first shipboard electric network (5) and of the nominal electrical supply of said at least one electrical drive motor (4, 1004) through said main electrical supply bus (11, 104) for a translation speed of the ship less than or equal to a specified speed, which may be for example 5 knots, and, electrical connection means (25, 111) arranged on board the ship to connect the set (10) of electric capacitors to another electric network located at an arrival point and/or a departure point of the ship for the purpose of recharging the capacitors to their nominal charge and for supplying the first shipboard electric network during a stop at the arrival point and/or the departure point.

For example, said at least one set of electric capacitors has a capacitance sized so as to provide, at their nominal electrical charge, 100% of both of the nominal supply of said at least one first shipboard electric network (5) and of the nominal electrical supply of said at least one electrical drive motor (4, 1004), allowing navigation where it is subject to an imposed specified speed limit, of the order of 5 knots for example, as for example in ports, port access channels (excepting local regulations) and in the 300 meter littoral strip (measured from the high water line), through said main electrical supply bus (11, 104).

According to embodiments of the invention:

The connection means on board the ship comprise conductors capable of being put into contact, during docking of the ship at the departure point and/or at the arrival point, with external conductors carried by mechanical means located at the departure point and/or at the arrival point for compensating differences in height, compensating for the distance between the ship and a dock at the departure and/or arrival point, and establishing electrical contact between the ship and the dock.

Or the connection means on board the ship comprise conductors carried by mechanical means arranged so as to compensate for differences in height between the ship and a dock at the departure and/or arrival point and to compensate for the distance between the ship and the dock, and arranged so as to be put into electrical contact, upon docking the ship at the departure point and/or at the arrival point, with electrical conductors provided on the dock.

The conductors of the ship's connection means are so arranged as to be put into contact, upon docking the ship at the departure point and/or at the arrival point, with external conductors carried by at least one pantograph located at the departure point and/or at the arrival point, the pantograph being capable of compensating for height differences, compensating for the distance between the ship and a dock at the departure and/or arrival point and establishing electrical contact between the ship and the dock.

The electrical connection means are provided on board the ship for connecting the set of electric capacitors to another electric network located at the arrival point and/or at the departure point, for the purpose of recharging the capacitors to their nominal charge and to supply the first shipboard electric network and said at least one electric drive motor during a stop at the arrival point and/or at the departure point.

The set of capacitors is of the supercapacitor type.

The supply means comprise at least one generator set for support and for emergency use driven by at least one internal combustion engine supplied from an on-board fuel reserve.

The set of electric capacitors has a capacitance sized so as to provide, at its nominal electrical charge, both a ratio equal to at least 50% of the nominal supply of said at least one shipboard electric network over the prescribed distance and of the nominal electrical supply of said at least one electric drive motor, allowing travel over the prescribed distance, through said main electrical supply bus.

The set of electric capacitors has a capacitance sized so as to provide, at their nominal electrical charge, both a ratio greater than or equal to 100% of the nominal supply of said at least one first shipboard electric network over the prescribed distance and of the nominal electrical supply of said at least one electric drive motor allowing travel over the prescribed distance, through said main electrical supply bus.

The set of electric capacitors has a capacitance sized to provide, at their nominal electrical charge, both a ratio greater than or equal to 130% of the nominal supply of said at least one first shipboard electric network over the prescribed distance and of the nominal electric supply of the at least one electric drive motor, allowing travel over the prescribed distance, through said main electrical supply bus.

The set of electric capacitors has a capacitance sized to provide, at their nominal electrical charge, both a ratio greater than or equal to 260% of the nominal supply of said at least one first shipboard electric network over the prescribed distance and of the nominal electric supply of the at least one electric drive motor, allowing travel over the prescribed distance, through said main electrical supply bus.

The set of electric capacitors has a capacitance sized so as to provide, at their nominal electrical charge, stored energy with a value greater than or equal to the following value $E_{min}$:

$$E_{min} := L \cdot (2 \cdot T + B) \cdot \sqrt{C_m} \cdot \left(0.453 + 0.4425 \cdot C_b - 0.2862 \cdot C_m - 0.003467 \frac{B}{T} + 0.3696 \cdot C_{wp}\right) \cdot \sqrt{2} \cdot \rho \cdot V^2 \cdot D$$

with

L=Waterline length of the ship's underwater hull in meters,

B=Waterline width of the ship's underwater hull in meters,

T=Full load draft of the ship in meters,

V=the highest service speed, in meters per second, that the ship can maintain when it is at its maximum displacement, ρ=mass density of the water in ton/$m^3$, DSPL=Full load displacement of the ship in $m^3$, $c_b$=Block coefficient=DSPL/(L×B×T), $C_{wp}$=Buoyancy coefficient, $A_w$=Full load waterline area in $m^2$, $C_{wp}=A_w/(L\times B)$, $C_m$=Main section coefficient=Transverse main section/(B×T);

Transverse main section=greatest transverse section of the ship below the waterline in $m^2$ at full load, D=prescribed distance in meters, $E_{min}$ in Joules being defined for each hull of the ship, and the total stored energy, in the case of a multihull ship, being equal to the sum of the energies defined for each hull.

The set of capacitors is in the form of a plurality of modules, each module containing supercapacitor type components so that each module forms an equivalent capacitance greater than 10 F.

The set of capacitors is in the form of a plurality of modules, each module containing supercapacitor type components so that each module has a nominal charge voltage of at least 25 V.

The set of capacitors is in the form of a plurality of modules, each module containing supercapacitor type components so that each module has a nominal charge voltage of at least 100 V.

The supercapacitors have a nominal allowable number of cycles greater than or equal to 100,000.

The set of capacitors comprises means for connecting several modules in series.

The set of capacitors comprises a plurality of branches, means for connecting the branches in parallel, each branch comprising several modules capable of being connected in series.

The ship is provided with electric circuit means sized to allow the set of capacitors's nominal charge to be reached from zero charge in a time less than or equal to 10 minutes.

The set of capacitors is connected to said direct current bus connected to the first DC side of at least one DC-AC converter, the AC side of which is connected to said at least one electric drive motor and to said first shipboard electric network to supply them with alternating current, the DC bus being also connected to the first DC side of at least one other DC-AC converter, the second AC side of which is connected to input conductors for connection to an external source of alternating current for recharging the capacitors.

Or the set of capacitors is connected to the first DC side of at least a first DC-DC converter, the second DC side of which is connected to said direct current bus connected to the first DC side of at least one DC-AC converter, the AC side of which is connected to said at least one electric drive motor and to said first shipboard electric network to supply them with alternating current, the direct current bus being also connected to the first DC side of at least one DC-DC converter, the second DC side of which is connected to input conductors for connection to an external source of direct current for recharging the capacitors.

Or the set of capacitors is connected to the first DC side of at least a first DC-AC converter, the second AC side of which is connected to said alternating current bus, the set of capacitors being also connected to the first DC side of at least a second DC-AC converter, the second AC side of which is connected to input conductors for connection to an external source of alternating current for recharging the capacitors and supplying the shipboard network, the alternating current bus being directly connected to the first shipboard electric network, the alternating current bus being connected to the first AC side of at least one AC-AC converter, the second AC side of which is connected to said at least one electric drive motor to supply it with alternating current.

Or the set of capacitors is connected to said direct current bus connected to the first DC input side of at least one DC-DC converter, the second DC output side of which is connected to said at least one DC electric drive motor to supply it with direct current, the direct current bus also being connected to the first DC side of at least a first DC-AC converter, the AC side of which is connected to said first shipboard electric network to supply it with alternating current, the direct current bus also being connected to the first DC side of at least one other DC-AC converter, the second AC side of which is connected to input conductors for connection to an external source of alternating current for recharging the capacitors.

Or the set of capacitors is connected to the first DC side of at least a first DC-AC converter, the second AC side of which is connected to said alternating current bus, the set of capacitors also being connected to the first DC side of at least a second DC-AC converter, the second AC side of which is connected to input conductors for connection to an external source of alternating current for recharging the capacitors and supplying the shipboard network, the alternating current bus being connected to the first AC side of at least one AC-DC converter, the second DC side of which is connected to said at least one DC electric drive motor to supply it with direct current.

Or the set of capacitors (10) is connected to the first DC side (42) of at least one DC-DC converter (41), the second DC side (43) of which is connected to said direct current bus (11) connected to the first DC side (12, 15, 18) of at least one DC-AC converter (13, 16, 19), the AC side (14, 17, 20) of which is connected to said at least one electric drive motor (4) and to said first shipboard electric network (5) to supply them with alternating current, the direct current bus (11) also being connected to the first DC side (22) of at least one other DC-AC converter (23), the second AC side (24) of which is connected to input conductors (25) for connection to an external source (100, S) of alternating current for recharging the capacitors.

Or the set of capacitors (10) is connected to the first DC side (42) of at least one DC-DC converter (41), the second DC side (43) of which is connected to said direct current bus (11) connected to the first DC input side of at least one DC-DC converter (1005, 1006), the second DC output side of which is connected to said at least one DC electric drive motor (1004) to supply it with direct current, the direct current bus (11) also being connected to the first DC side (12) of at least a first DC-AC converter (13), the AC side (14) of which is connected to said first shipboard electric network (5) to supply it with alternating current, the direct current bus (11) also being connected to the first DC side (22) of at least one other DC-AC converter (23), the second AC side (24) of which is connected to input conductors (25) for connection to an external source of alternating current (100, S) for recharging the capacitors.

Or the bus (11) carries direct current; the set of capacitors (10) is connected to the bus (11) through at least one DC-DC converter (41).

Said electrical connection means on board the ship are located near its docking area and comprise conductors capable of being put into contact with complementary conductors remaining at the departure point and/or at the arrival point, for recharging the capacitors.

The ship's so-called quick connectors are arranged so as to be put into contact, upon docking the ship, with said external electrical conductors carried by an arm and/or a mobile pantograph located at the departure point and/or at the arrival point.

The pantographs held in position near the departure point are capable of being put into contact, upon docking the ship at the departure point and/or at the arrival point, with said bare conductors of connection means (catenaries) located on posts positioned near the docking points on the ship.

Or the so-called quick connectors of the ship are carried on a mechanical arm and/or a mobile pantograph and arranged so as to be put into contact, upon docking the ship, with said external conductors located at the departure point and/or at the arrival point.

BRIEF DESCRIPTION OF THE DRAWINGS

The invention will be better understood upon reading the description that follows, presented only as a non-limiting example, with reference to the annexed drawings, in which.

DETAILED DESCRIPTION

Figure 1:
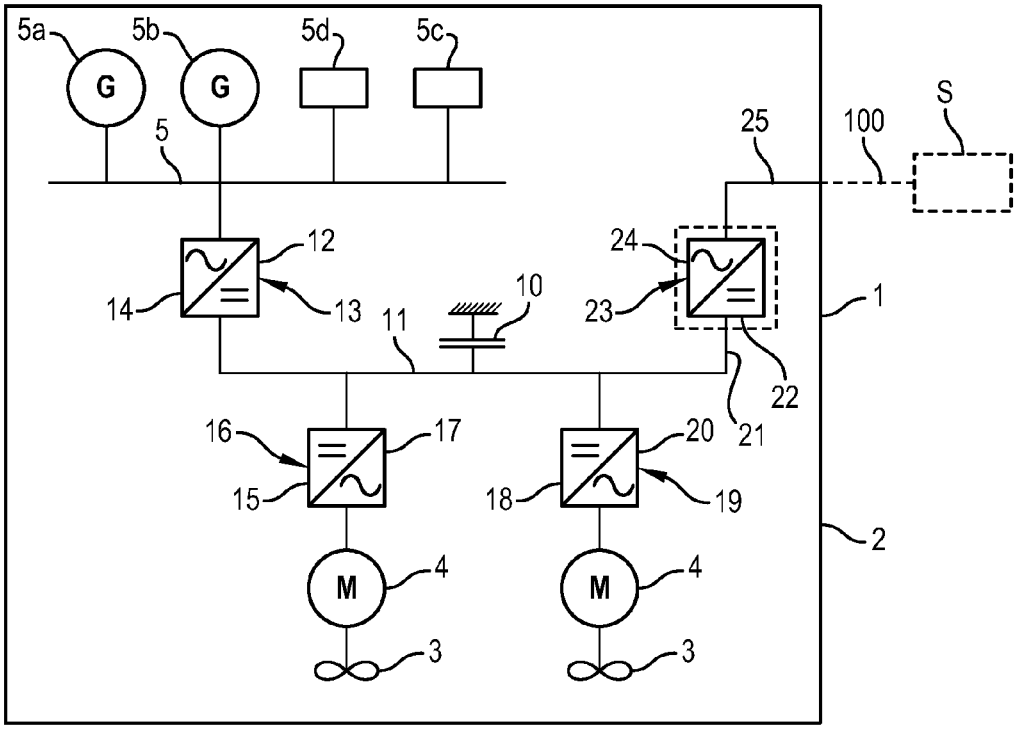
FIG. 1 shows an overall electrical schematic of the ship according to a first embodiment based on a direct-current bus and an alternating-current propulsion motor.

In the figures, ship 1 comprises a hull 2 and means 3 for propulsion through the water, such as for example one or more propellers 3. Propulsion means 3 are set in motion by one or more electric motors 4. Ship 1 also comprises a shipboard electric network 5 comprising for example lighting 5*c*, heating 5*d*, safety and navigation systems, machinery controls, living spaces and all the electrical installations on board the ship other than the motor(s) 4 used for propulsion.

According to the invention, the shipboard electric network 5 and the electric propulsion motor(s) 4 are supplied with electricity from an on-board set 10 of electric capacitors and optionally by engine-generator sets. The electrical capacitance of the set 10 is sized to be able to provide from 5 to 100% of the nominal capacitance corresponding to the propulsion of the ship 1 over a prescribed distance corresponding to travel between a departure point and an arrival point, this arrival point being either different from or identical to the departure point.

The electrical capacitance and the nominal electrical charge of the set of capacitors 10 are calculated so as to provide a ratio R of from 5 to 100% endurance in electricity supply to the ship's propulsion motor(s) 4 and to provide the electricity consumed during the trip by the shipboard electric network 5. Generally, $5\% \leqq R \leqq 100\%$. More particularly, $R \geqq 25\%$, or $R \geqq 50\%$. For greater safety, $100\% \leqq R \leqq 130\%$ or $130\% \leqq R \leqq 260\%$, or $100\% \leqq R \leqq 260\%$, or $R \geqq 260\%$, considering that 100% corresponds to a one-way trip from the departure point to the arrival point or a return trip from the arrival point to the departure point, 30% to a one-way trip safety margin, 200% to a round trip and 60% to a safety margin for a round trip.

In particular, the set of capacitors 10 comprises supercapacitor type components capable of being very rapidly recharged during the limited time available during the stops, then being slowly discharged during the crossing from the departure point and/or the arrival point. The capacitors in set 10 are for example grouped into several distinct modules, each having a distinct outer case. Set 10 thus comprises for example several banks of supercapacitors.

A sizing example for a ship assigned to traveling a fixed prescribed distance is the following:

for a ferry of 2,300 tons and about 100 meters long, having to transport up to 350 passengers, 115 cars and 10 heavy trucks over a prescribed distance of 2 to 3 nautical miles at a speed of about 12 to 13 knots, a one-way trip over this prescribed distance requires an energy of 185 kWh;

to take wind, waves and maneuvers at the departure and at the arrival point into account, a margin of 30% is added, which gives a nominal energy to be stored in the capacitors of 240 kWh;

the voltage of the electric motor(s) 4 is from 500 to 1,000 V, typically 690 V;

2,650 capacitor modules are used to make up the set 10, each module having a capacitance of 63 F, the modules having an equivalent electrical capacitance of 2,520 F; each module has a nominal voltage of 125 V; these capacitor modules have a weight of 150 tons out of the 2,300 tons of the ferry.

The supercapacitor modules are for instance modules with the catalog number BMOD0063-125V from the firm MAXWELL TECHNOLOGIES, each having a nominal capacitance of 63 F and a nominal operating voltage of 125 V, based on BOOSTCAP BCAP3000 supercapacitors having a capacitance of 3,000 F and an operating voltage of 2.7 V.

This type of capacitor can be charged to its nominal charge voltage in about 5 minutes. This stop period at the departure point and at the arrival point can be used for loading and unloading of passengers and vehicles.

This sizing takes into account about 12 minutes' travel between the departure point and the arrival point, and of a total of 2 to 3 minutes of maneuver time for docking at the departure point and at the arrival point.

This examplary set of capacitors 10 allows a complete cycle of 20 minutes to be completed, allowing travel over the prescribed distance of 2 to 3 miles and recharging of the capacitors for undertaking a new cycle. Of course, the ship can be other than a ship assigned to travel over a prescribed distance.

Of course, the capacitors could be used to travel only a part of the distance, the rest of the distance being traveled while supplied from one or more Diesel engines provided on the ship. A system can be provided on the ship for switching between supply by the set of capacitors 10 and supply by Diesel engine(s). One possibility in particular is to travel a port entrance distance and/or departure distance from port, that is in the zone near the port, by being supplied uniquely from the set of capacitors 10, to avoid pollution due to Diesel engines. This zone extends for example less than a nautical mile from the port, for example about 0.3 nautical miles. The set of capacitors 10 can for example be used for supply at low translation speeds, for example less than a prescribed speed, being possibly of the order of 5 knots, which corresponds generally to the speed limit in ports, port access channels and the littoral strip.

In the embodiment of FIG. 1, the set of capacitors 10 is directly connected to a direct-current bus 11. Direct-current bus 11 is connected to the first DC side 12 of a first DC-AC converter 13, the second AC side 14 of which is connected to the shipboard electric network 5. Direct-current bus 11 is connected to the first DC side 15 of a second DC-AC converter 16, the second AC side 17 of which is connected to electric motor 4 to supply it with alternating electrical current to set in rotation a first propulsive screw 3. In the event that another propulsive screw 3 is provided, the direct-current bus 11 is connected to the first DC side 18 of a third DC-AC converter 19, the second AC side 20 of which is connected to another electric motor 4 to supply it with alternating electrical current in order to set in rotation another propulsive screw 3.

The direct-current bus 11 is also connected on the ship 1 by electrical conductors 21 to the first DC side 22 of a fourth DC-AC converter 23, the second AC side 24 of which is connected to second electrical conductors 25 carrying alternating current. These conductors 25 are for connection to a source of alternating current when the ship is at the departure point and/or arrival point.

To this effect, the departure point and/or arrival point, which comprises for instance a dock, comprises a shore electric network S capable of providing alternating electrical current over external output conductors 100 not incorporated into the ship. When the ship is stopped at the departure point and/or at the arrival point equipped with these output conductors 100, conductors 25 are connected to the output conductors 100 to receive alternating current from the source located at that departure point and/or at that arrival point. FIG. 1 shows the ship in that situation. The current provided by the output conductors 100 then recharges the set of capacitors 10 to its nominal charge and supplies the first shipboard electric network 5 and the drive motors 4. Conductors 25 are then disconnected from output conductors 100 and the ship then leaves the departure point and/or the arrival point.

Figure 2:
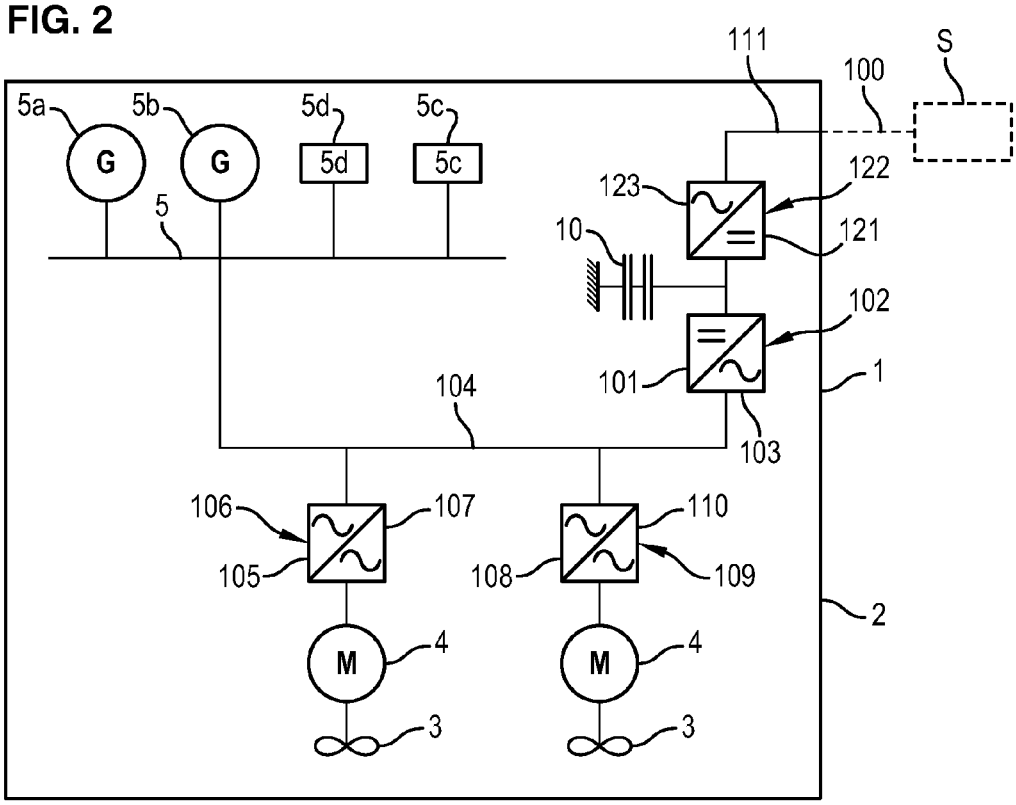
FIG. 2 shows an overall electrical schematic of the ship according to a second embodiment based on an alternating-current bus and an alternating-current propulsion motor.

In the embodiment of FIG. 2, the set of capacitors 10 is connected to the first DC side 101 of a first DC-AC converter 102, the second AC side 103 of which is connected to an alternating-current bus 104. Alternating-current bus 104 is directly connected to shipboard electric network 5. Alternating-current bus 104 is connected to the first AC side 105 of a second AC-AC converter 106, the second AC side 107 of which is connected to electric motor 4 to supply it with alternating current in order to set in rotation a first propulsive screw 3. In the case where another propulsive screw 3 is provided, alternating-current bus 104 is connected to the first side 108 of a third AC-AC converter 109, the second AC side 110 of which is connected to another electric motor 4 to supply it with alternating current, in order to set in rotation this other propulsive screw 3. The set of capacitors 10 is also connected to the first DC side 121 of a second DC-AC converter 122, the second AC side 123 of which is connected to electrical conductors 111. Electrical conductors 111 are to be connected to output conductors 100 located at the departure point and/or at the arrival point during the ship's stop at that departure point and/or at that arrival point.

Figure 3:
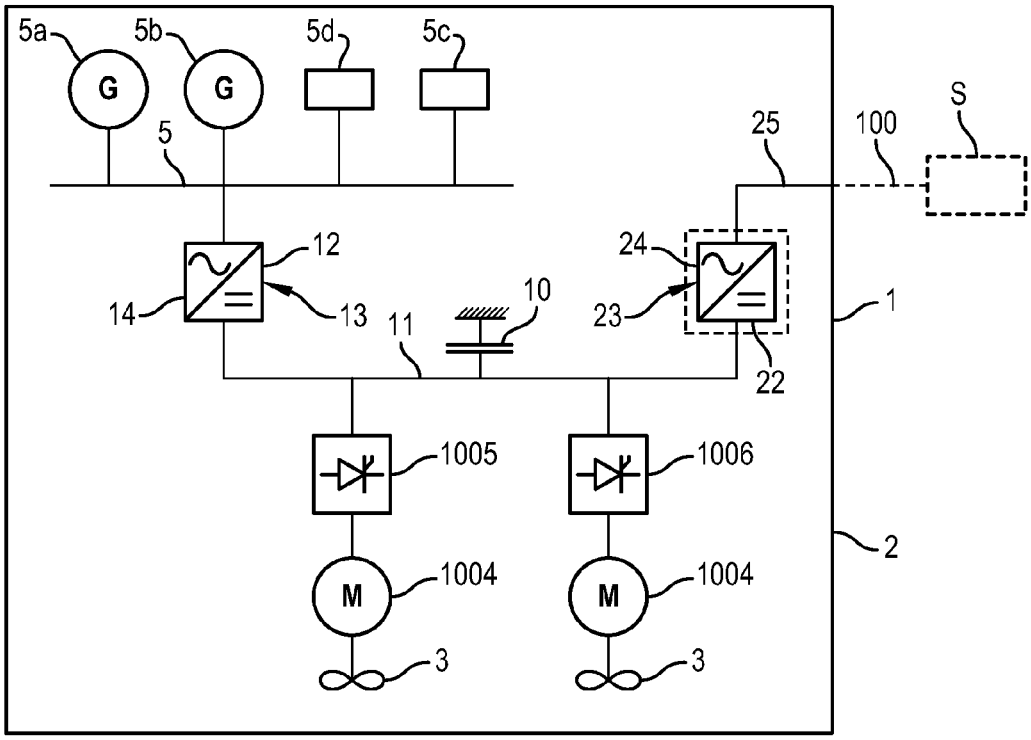
FIG. 3 shows an overall electrical schematic of the ship according to a variant of FIG. 1 based on a direct-current bus and a direct-current propulsion motor.
Figure 4:
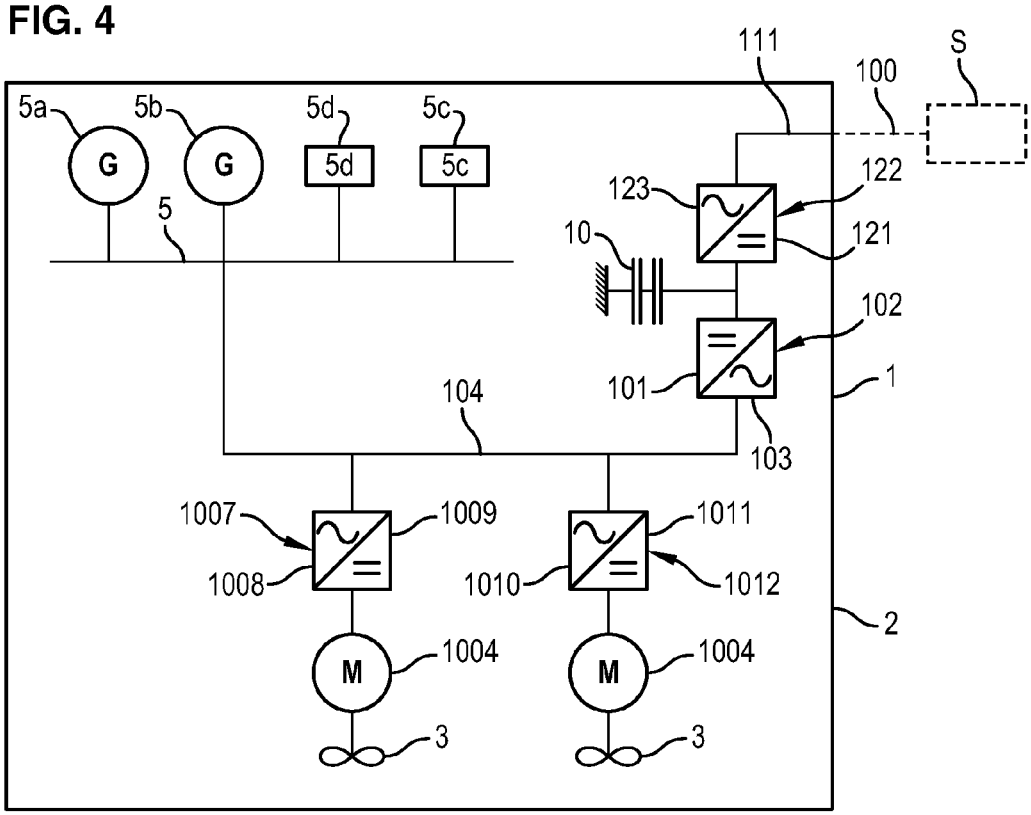
FIG. 4 shows an overall electrical schematic of the ship according to a variant of FIG. 2 based on an alternating-current bus and a direct-current propulsion motor.

FIG. 3 is a variant of FIG. 1, where the alternating-current motor(s) 4 are replaced by one or more direct-current motors 1004 and where the converter(s) 16, 20 are replaced by one or more chopper type DC-DC converters 1005, 1006 between direct-current bus 11 and direct-current motor(s) 1004, to transform the direct voltage of direct-current bus 11 into a variable direct voltage for operating direct-current motor(s) 1004. FIG. 4 is a variant of FIG. 2, where alternating-current motor(s) 4 are replaced by one or more direct-current motors 1004 and where converter(s) 106, 109 are replaced by one or more AC-DC converters 1007, 1012, for example one or more rectifiers, between the alternating-current bus 104 and direct-current motor(s) 4 to supply a variable direct voltage to motor(s) 4. AC side 1008 of AC-DC converter 1007 is connected to alternating-current bus 104. DC side 1009 of AC-DC converter 1007 is connected to a first direct-current motor 1004 setting in rotation first propulsive screw 3. AC side 1010 of AC-DC converter 1012 is connected to alternating-current bus 104. DC side 1011 of AC-DC converter 1012 is connected to a second direct-current motor 1004 setting in rotation second propulsive screw 3. In another embodiment, converter 23 or 122 is located not on the ship, but upstream of output conductors 100. In this embodiment, conductors 100 supply main direct-current bus 11 directly.

Figure 5:
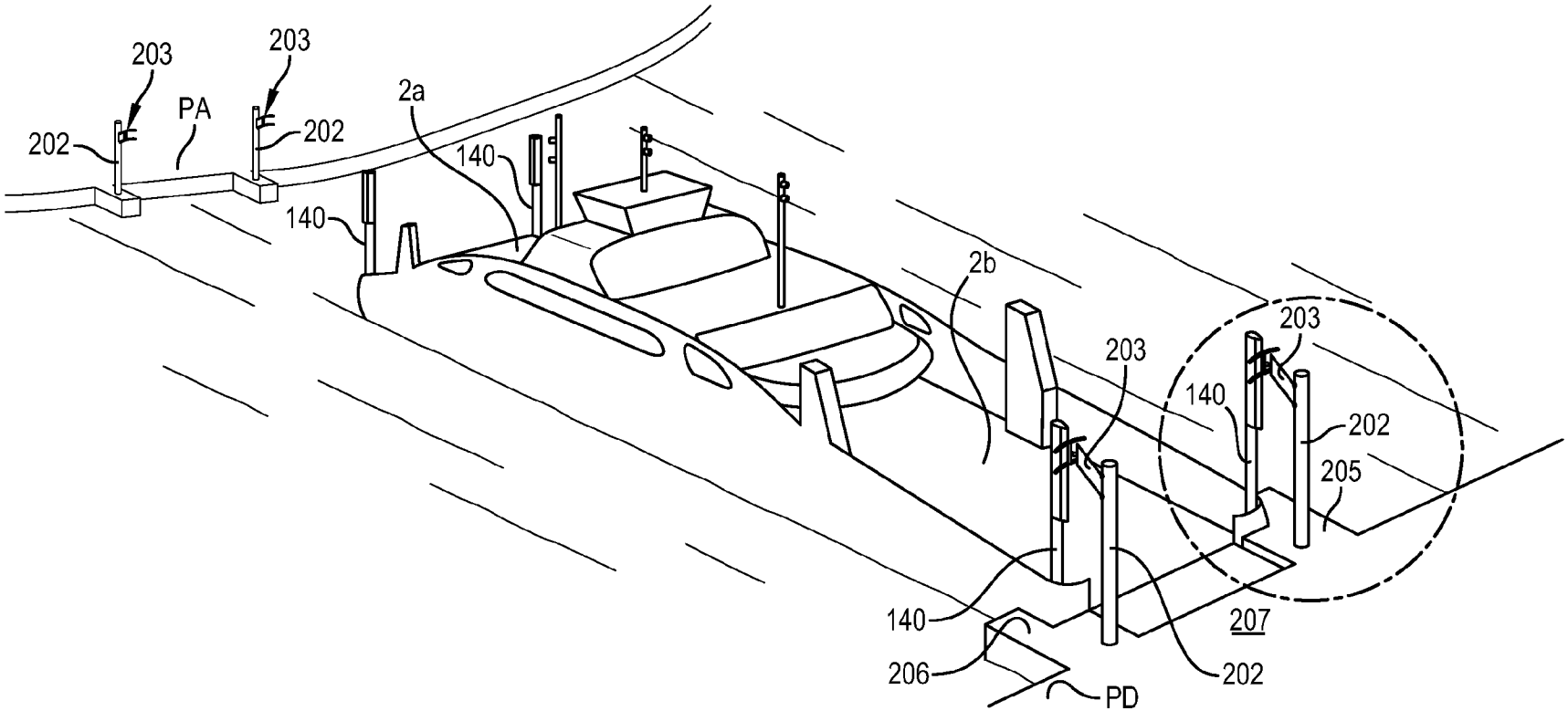
FIG. 5 is a perspective view of one embodiment of the ship's connection means according to the invention.

FIG. 5 represents one of the embodiments of connection means 25, 111 and 100. Connection conductors 25, 111 located on the ship are for example provided on a strut or stanchion 140 located at the stern and/or the bow of ship 1, on the port and/or starboard side, for example port and starboard sides, at the stern 2*a* and at the bow 2*b* in FIG. 5, stanchion 140 being turned toward the departure point PD and/or the arrival point PA upon docking (distances between points PA and PD not being shown to scale in FIG. 5). Output conductors 100 connected to electricity source S are for example of the pantograph type.

The connection means located at the departure point and/or at the arrival point comprises a means 202, in the form of a post 202 for example, which supports at least one pantograph 203. For example, in FIG. 5, two posts 202 are provided, each supporting a pantograph 203, so that each one comes into contact with conductors 25 or 111 of an associated stanchion 140. Of course, any number of stanchion 140-pantograph 203 pairs can be provided, the number being at least equal to one.

Figure 6:
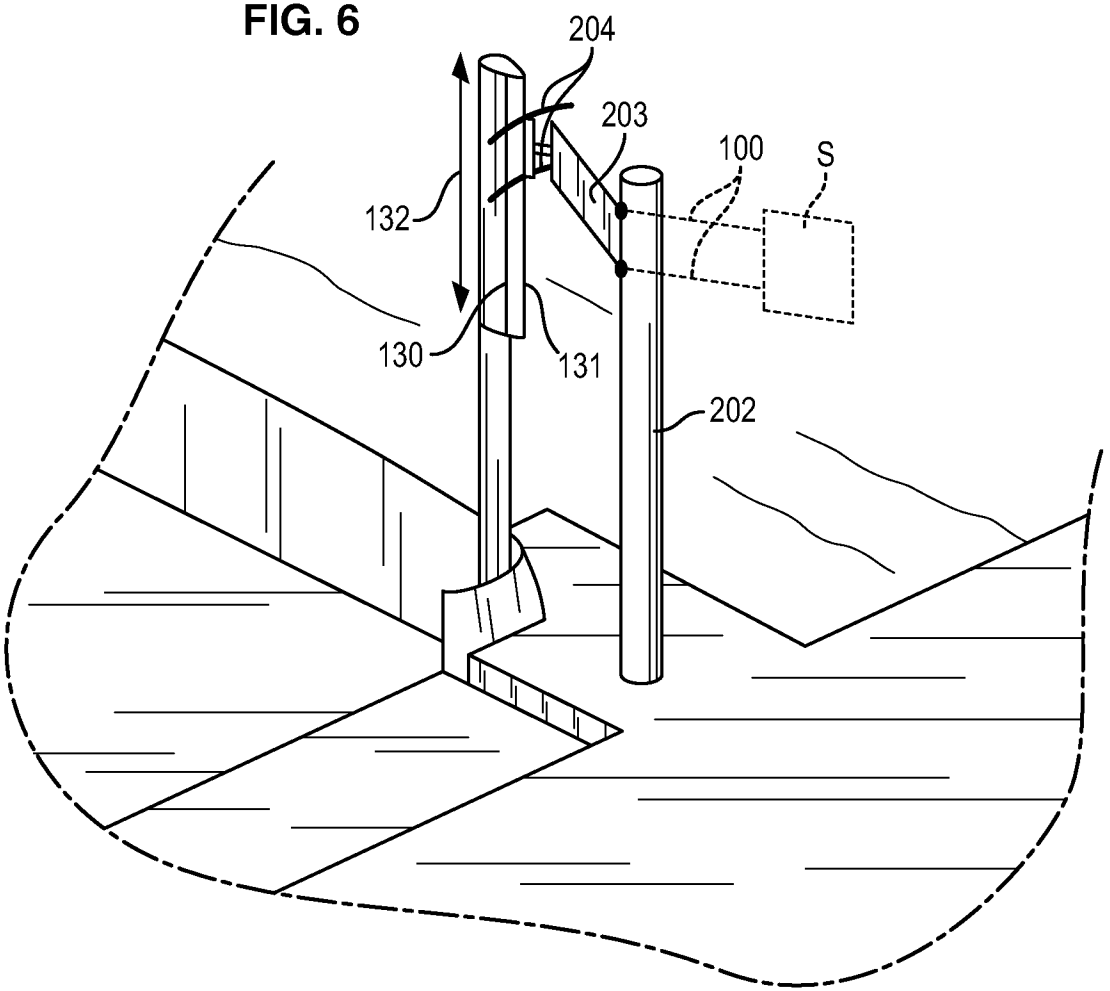
FIG. 6 is an enlarged perspective view of a part of FIG. 5.

FIG. 6 is an enlarged view of a stanchion 140 located on the ship and of a pantograph 203 carried on its post 202 attached to the departure point or to the arrival point. Pantograph 203 comprises conductors 204 turned outward with respect to the shore; these conductors 204 being connected to output conductors 100, themselves connected to shore-based alternating current source S. Pantograph 203 is for example provided on the dock or on boarding and debarking gangway 207 where the ship will dock, as shown in FIG. 5.

The ship's strut 140 supports a means for connecting conductors 25, 111 to pantograph 204 upon docking. These connection means are constituted, for example, of two bare and separate conductors (catenaries) 130, 131 tightened in front of strut 140 located at the front and rear of the ship, allowing conductors 204 of pantograph 203 to slide on conductors 130, 131 and to compensate the motion of ship 1 due to its loading and the motions of the water's surface. Bare conductors 130 and 131 extend over a range 132 having a prescribed height, so that pantograph conductors 204 may rise and fall within this height range 132 in compliance with the ship's motions. The pantograph makes possible a horizontal displacement of these conductors 204 with respect to stanchion 202 by constraining its conductors 204 to be applied to conductors 130 and 131, in compliance with the ship's motions. The pantograph also gives its conductors 204 a degree of freedom in height with respect to stanchion 202, in compliance with the ship's motions.

Once the boat has docked, the conductors 130 and 131 of ship 1 are constantly in contact with conductors 204 of pantograph 203 for recharging the set of capacitors 10 for a prescribed time from source S. The alternating current supplied by source S to conductors 25, 111 is high voltage alternating current with for example an RMS voltage on the order of 20,000 V. The pantograph allows adjustment to the fore and aft motions of the ship, and an adjustment to water motion. Posts 202 are for example provided on a lateral extension 205 of dock 207. For example, two lateral extensions 205 and 206 are provided, between which is the loading and unloading zone 207 on the dock for passengers and/or vehicles, the distance between the two extensions 205 and 206 being greater than the width of the ship at its stern and/or at its bow for docking by the stern or by the bow to dock 207.

Figure 7:
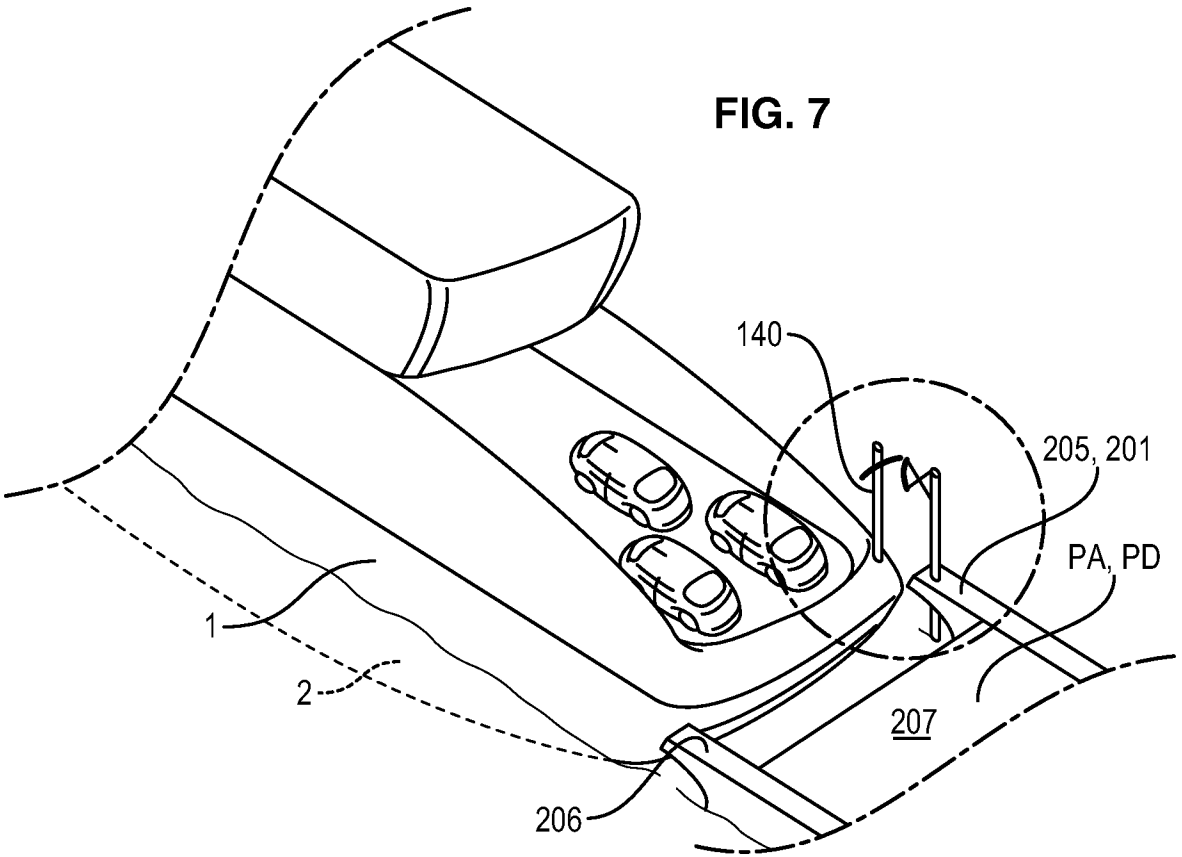
FIG. 7 is a perspective view of a variant of FIG. 5.
Figure 8:
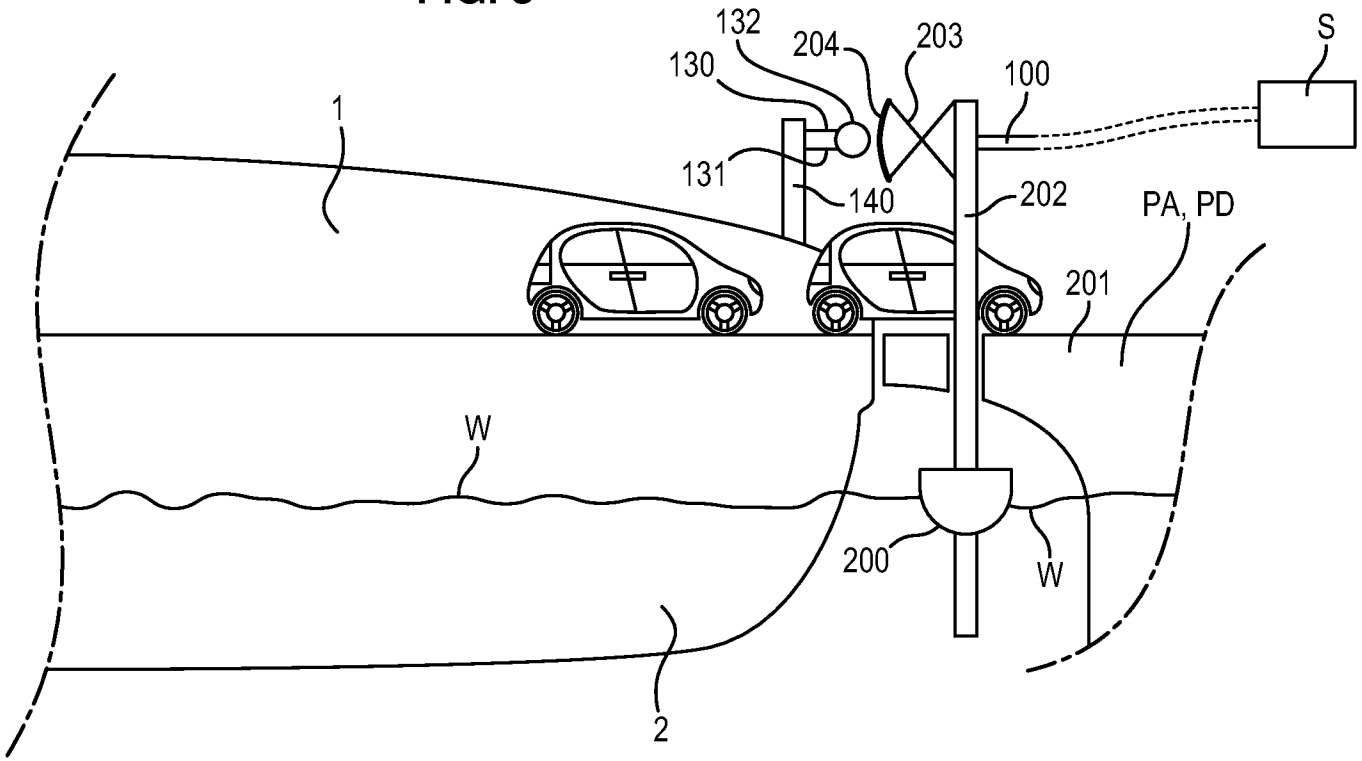
FIG. 8 is an enlarged perspective view of a part of FIG. 7.

FIGS. 7 and 8 show a variant of FIGS. 6 and 7, where stanchion 202 is movable with respect to the departure point PD and/or to the arrival point PA. Stanchion 202 is provided on a float 200 running in a guide 201 fixed to the shore. Guide 201 holds the post in a position in horizontal coordinates, with a degree of freedom in height in compliance with the motions of the water surface W on which the float 200 is located.

In another embodiment, the pantograph described above could be provided on the ship, conductors 25 or 111 being connected on the ship to conductors 204 of pantograph 203, and conductors 130, 131 being connected to current source S and being provided at the departure point and/or at the arrival point. In another embodiment, connection means 25, 111 and 100 could also be in the form of a robot or of a mechanical arm on the ship and/or on the dock.

The supercapacitors, or ultracapacitors or modules used have an allowable number of cycles greater than or equal to 100,000, even 500,000 or 1,000,000. The supercapacitors used in set 10 have the advantage of a large number of possible working charge and discharge cycles, which is one million in the sizing example given above. This improves the life of the ship's electrical supply. Thus, in the case of a ferry which has to carry out 25 round trips per day, or 50 crossings, the life of the set of capacitors is about 30 years.

The supercapacitors, or ultracapacitors or modules used are used with an on-board electrical circuit sized for the ship allowing a nominal charge in a time less than or equal to 10 minutes, even less than or equal to 5 minutes or 3 minutes, so that charging can be carried out during a stop at the departure point and/or at the arrival point. The electrical circuit at the departure point and/or the arrival point is also sized to allow this charging time, with a transformer adequately sized for reaching the connection means.

The modules are for example arranged in series to reach a required full-charge voltage of for example 960 V DC in the numerical example given above, where 8 modules are arranged in series, each contributing 120 to 125V. For example, at least two or three modules are in series. Several branches, with at least two or three modules in series in each branch, are for example arranged in parallel in set 10, for example 320 branches of 8 modules each in series in the numerical example above.

The connection means described with reference to the figures ensures rapid connection of the ship for recharging the capacitors. In one embodiment, the ship comprises at least one diesel engine for support and for emergency use, and a fuel reserve sufficient for conveying and for dealing with hazards at sea.

Under normal navigation conditions over a prescribed crossing between a departure point and an arrival point, the set of supercapacitors 10 can be sized to provide the total energy source needed for the crossing. The diesel engine can be used for support or for emergency supply for the set (10), the power bus 11 or 104, as well as the ship's shipboard system 5, but it is not the sole main energy source. Depending on the embodiment, the ship is also equipped with at least one generator set which can supply power bus 11 and shipboard electric network 5.

Compared with a ship propelled by diesel engines based on fossil fuels, the ship can have as a main energy source over prescribed crossings electricity provided by the dock. This will considerably reduce the $CO_2$ footprint of the ship and will considerably reduce the fuel costs for the Diesel engine. According to the invention, the supply means comprise a set (10) of electrical capacitors having a capacitance sized to provide, at their nominal charge, at least 25% of the energy needs of the ship over the prescribed distance.

Upon docking at the port, the ship connects itself to another electric network located at the arrival point and/or at the departure point for the purpose of recharging the capacitors to their nominal charge and to supply power bus 11 or 104 and shipboard electric network 5. In the foregoing, the set of capacitors 10 can be connected to the rest of the electrical circuit by at least one DC-DC converter.

Figure 9:
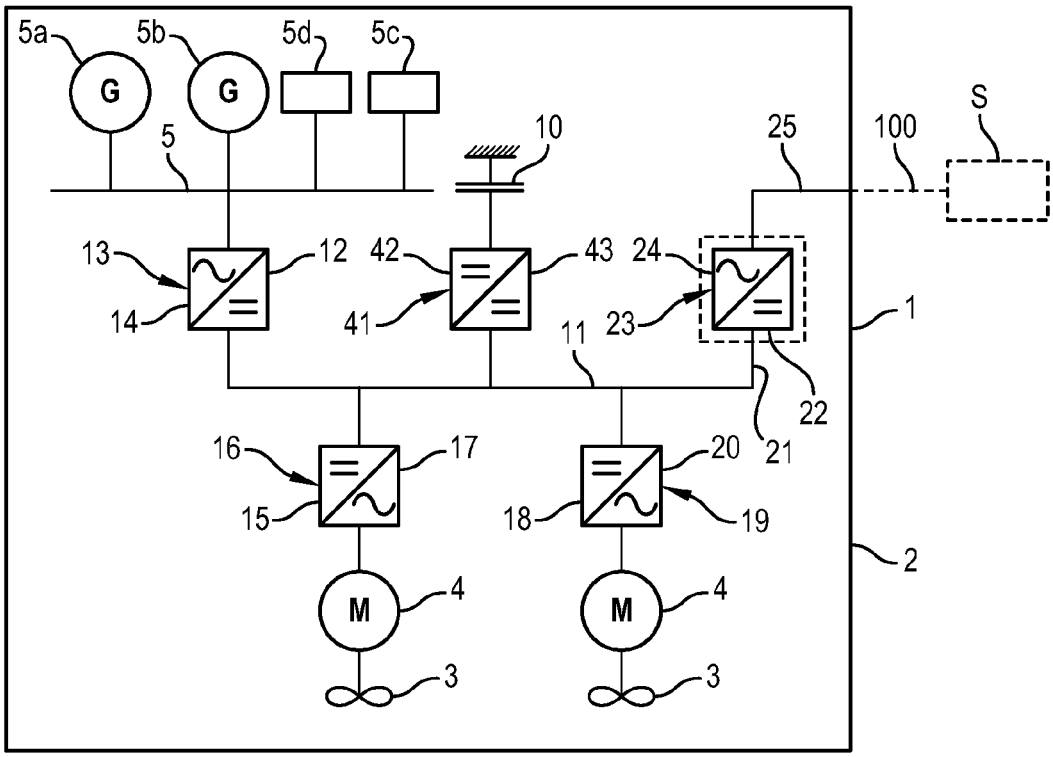
FIG. 9 shows an overall electrical schematic of the ship according to a third embodiment based on a direct-current bus and an alternating-current propulsion motor.

The embodiment of FIG. 9 is similar to that of FIG. 1, with the same constitutive components, with in addition a DC-DC converter 41 between the set of capacitors 10 and direct-current bus 11. The DC-DC converter 41 comprises a first DC side 42 connected to the set of capacitors 10 and a second DC side 43 connected to direct-current bus 11. The DC-DC converter 43 provides the interface between the capacitors of the set 10, the voltage of which varies with their charge level, and the main direct-current distribution bus 11, which has a fixed voltage. In the case of FIGS. 1 through 4, where the capacitors of set 10 are connected directly to main direct-current distribution bus 11, the converters connected to this main distribution bus must be regulated to take into account the voltage variation of bus 11 during the charge and discharge phases of the capacitors in set 10.

Figure 10:
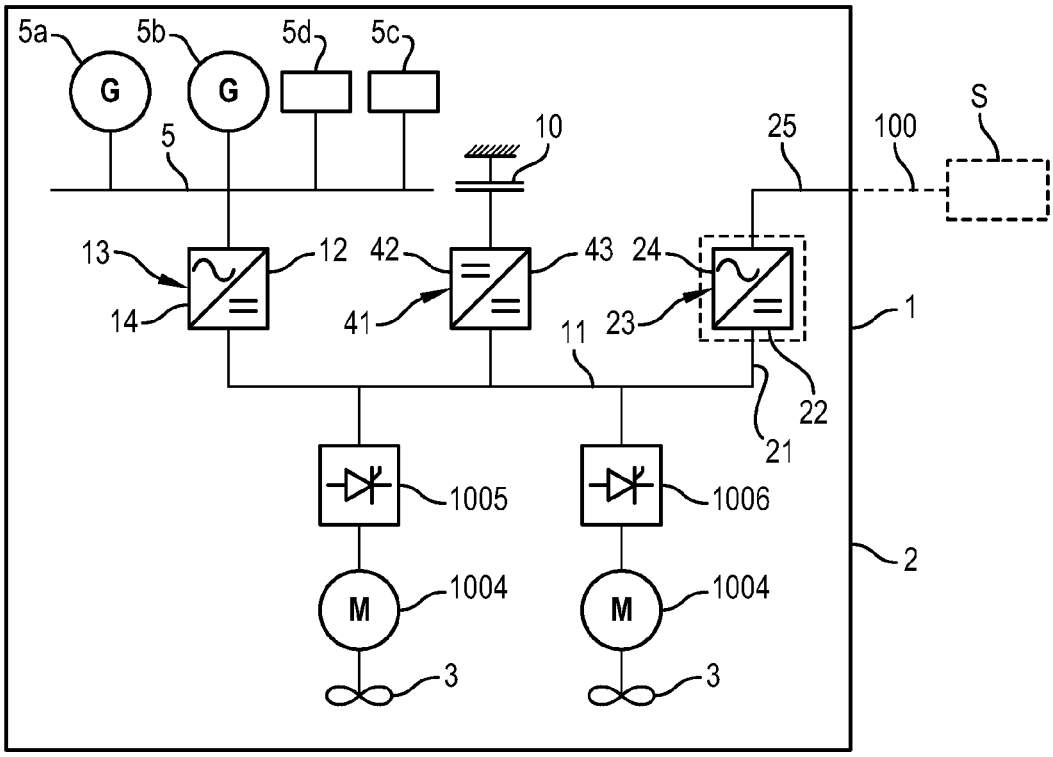
FIG. 10 shows an overall electrical schematic of the ship according to a fourth embodiment based on a direct-current bus and an alternating-current propulsion motor.

The embodiment of FIG. 10 is similar to that of FIG. 3, with the same constitutive components, with in addition a DC-DC converter 41 between the set of capacitors 10 and the direct-current bus 11. The DC-DC converter 41 comprises a first DC side 42 connected to the set of capacitors 10 and a second DC side 43 connected to the direct-current bus 11. In FIGS. 2 and 4, the set of capacitors 10 can also be connected to DC-AC converters 102 and 122 by way of at least one DC-DC converter.

The invention claimed is:

1. A self-propelled ship, the ship comprising at least a first shipboard electric network, at least one main electrical supply bus, a propulsion device, at least one drive motor for driving the propulsion device, and a generator operably supplying electricity to the first shipboard electric network and the at least one drive motor through the main electrical supply bus, wherein:

the generator further comprises at least one set of electric capacitors having a capacitance sized so as to provide, at their nominal electrical charge, at least temporarily, both a nominal supply of the at least one first shipboard electric network and a nominal electrical supply of the at least one electric drive motor through the main electrical supply bus; and an electrical connector arranged on board the ship connecting the set of electric capacitors to another electric network located at at least one point selected from: (a) an arrival point and (b) a departure point, of the ship, for the purpose of recharging the capacitors to their nominal charge and to supply the first shipboard electric network during a stop at the point.

2. The ship according to claim 1, wherein:

the ship is assigned to navigation over a prescribed distance situated between a departure point and an arrival point, the at least one set of electric capacitors having a capacitance sized to provide, at their nominal electrical charge, a ratio equal to at least 25% of both of the nominal supply of the at least one first shipboard electric network over the prescribed distance and of the nominal electrical supply of the at least one electric drive motor, allowing travel over the prescribed distance, through the main electrical supply bus; and the electrical connector is arranged aboard the ship for connecting the set of electric capacitors to the other electric network located at the point of the ship, for the purpose of recharging the capacitors to their nominal charge and to supply the first shipboard electric network during a stop at the point.

3. The ship according to claim 1, wherein the at least one set of electric capacitors has a capacitance sized to provide, at their electric nominal charge, both the nominal supply of the at least one first shipboard electric network over a prescribed distance and the nominal electrical supply of the at least one electric drive motor allowing travel over the prescribed distance, through the main electrical supply bus.

4. The ship according to claim 1, wherein the at least one set of electric capacitors has a capacitance sized to provide, at their nominal electrical charge, both the nominal supply of the at least one first shipboard electric network and the nominal electrical supply of the at least one electric drive motor through the main electrical supply bus for a ship translation speed less than or equal to a specified speed limit.

5. The ship according to claim 1, wherein the connector on board the ship comprises conductors capable of being put into contact, upon docking the ship at the point, with external conductors carried by mechanical means located at the point for compensating differences in height, compensating for the distance between the ship and a dock at the point, and to establish electrical contact between the ship and the dock.

6. The ship according to claim 1, wherein the connector on board the ship comprises conductors carried by mechanical means arranged so as to compensate the differences in height between the ship and a dock at the point and to compensate the distance between the ship and the dock, and arranged so as to be put into electrical contact, upon docking the ship at the point, with external conductors arranged on the dock.

7. The ship according to claim 1, wherein the set of capacitors is of the supercapacitor type.

8. The ship according to claim 1, wherein the generator comprises at least one generator set for support and for emergency use driven by at least one internal combustion engine supplied from an on-board fuel reserve.

9. The ship according to claim 1, wherein the set of capacitors comprises a plurality of branches, means for connecting the branches in parallel, each branch comprising several modules capable of being connected in series.

10. The ship according to claim 1, wherein the ship is provided with an electrical circuit sized to allow a nominal charge of the set of capacitors from zero charge within a time less than or equal to 10 minutes.

11. The ship according to claim 1, wherein the set of capacitors is connected to a first DC side of at least one DC-DC converter, a second DC side of which is connected to the main electrical supply bus being a direct-current bus connected to a first DC side of at least one DC-AC converter, an AC side of which is connected to the at least one electric drive motor and to the first shipboard electric network for supplying them with alternating current, the direct-current bus also being connected to a first DC side of at least one other DC-AC converter, a second AC side of which is connected to input conductors for connection to an external source of alternating current, for recharging the capacitors.

12. The ship according to claim 1, wherein the electrical connector aboard the ship is located near the ship's docking area and comprises conductors capable of being put into contact with complementary conductors remaining at the point, for recharging the capacitors.

* * * * *